United States Patent [19]

Gebert et al.

[11] 4,434,194

[45] Feb. 28, 1984

[54] EDGE DAM FOR PAPER COATING APPARATUS AND METHOD

[75] Inventors: Kenneth W. Gebert, Wisconsin Rapids; Pat A. Rajski, Stevens Point, both of Wis.

[73] Assignee: Consolidated Papers, Inc., Wisconsin Rapids, Wis.

[21] Appl. No.: 350,758

[22] Filed: Feb. 22, 1982

[51] Int. Cl.[3] ..... B05C 5/02

[52] U.S. Cl. ..... 427/356; 118/410; 118/413

[58] Field of Search ..... 118/407, 413, 259, 410; 101/207, 208, 210, 363, 364; 427/356, 358

[56] References Cited

U.S. PATENT DOCUMENTS

| | | | |
|---|---|---|---|
| 3,032,007 | 5/1962 | McCauliff | 118/259 X |
| 3,478,439 | 11/1969 | Hyldon | 118/407 X |
| 4,327,662 | 5/1982 | Damrau | 118/410 |

*Primary Examiner*—John P. McIntosh

*Attorney, Agent, or Firm*—Gary, Juettner & Pyle

[57] ABSTRACT

An edge dam assembly for an applicator for applying a film of coating material on a moving web of paper carried through an application zone, is characterized by a seal element at each side end of the zone. To prevent leakage of coating liquid past the seal element, air is introduced through the element and into the side end of the zone adjacent to the element. The air forms an air barrier pocket at the side end of the zone, which is void of coating liquid, whereby coating liquid is maintained in the zone inwardly of the seal elements.

15 Claims, 3 Drawing Figures

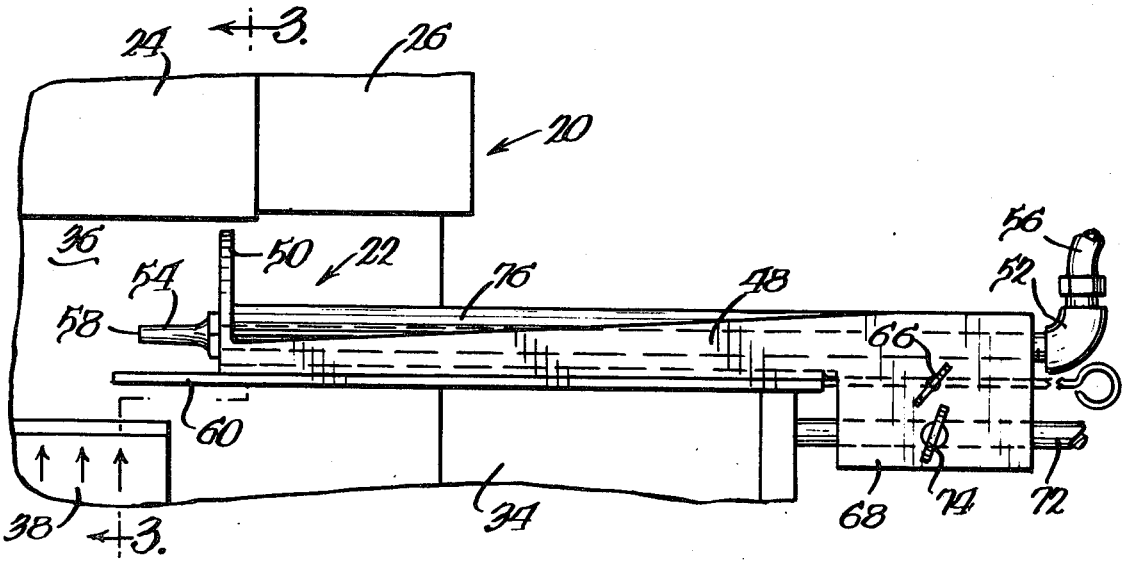

EDGE DAM FOR PAPER COATING APPARATUS AND METHOD

BACKGROUND OF THE INVENTION

The present invention relates to an improved edge dam for use with applicators of the trailing blade type for applying a coating liquid to a moving web of paper.

Conventional applicators of the trailing blade type include means for applying coating liquid to a paper web that is usually supported and carried by a backing roll. Such applicators include a chamber having an opening extending across and parallel to the web, together with a doctor blade at a trailing side of the opening for leveling the coating and a front wall or orifice plate extending from a leading side of the opening toward the web and defining an orifice for exit of excess coating material from an application zone between the wall and doctor blade. Coating liquid is supplied to the chamber and thence through the chamber opening into the application zone, and to seal end spaces between the front wall and doctor blade at side ends of the zone to prevent escape of coating material laterally of the web, edge dams are provided thereat.

For applicators of the foregoing type, the edge dam often comprises a felt, plastic or metal material configured to fill a somewhat triangular shaped opening at either end of the application zone defined by the doctor blade, orifice plate and backing roll. Ideally, the edge dam absolutely prevents leakage of any coating liquid to exterior of the applicator. However, that can require that the edge dam be in contact with the paper web, and wear or abrasion of the edge dam or marking and tearing of the web may occur. Consequently, the edge dam is only positioned closely adjacent to, but spaced from, the web, and some coating liquid seeps therepast.

In use of edge dams, an effort is made to minimize leakage of coating liquid. However, it is usually very difficult, if not impossible, to mount edge dams at the side edges of the application zone in sufficiently close proximity to the paper web to allow only an acceptably small amount of leakage. In practice, coating liquid often leaks past the edge dam, with the result that the web edges become contaminated by stickers of coating liquid, which bind together adjacent edges of a wound paper roll and prevent the roll from later being properly unwound.

If leakage of coating liquid past edge dams could be eliminated or at least significantly minimized, it would then be possible to coat only the center portion of a paper web, leaving narrow uncoated strips along opposite side edges of the web. This would advantageously reduce or eliminate coating material buildup on backing rolls following the coater as well as edge stickers on the coater backing roll and web. Unfortunately, conventional edge dams do not ordinarily permit the foregoing to be accomplished.

OBJECTS OF THE INVENTION

An object of the present invention is to provide an improved edge dam for a paper coater which eliminates or very significantly minimizes leakage of coating material therepast.

Another object is to provide such an edge dam which accommodates introduction of air into the side end of an application zone of a coater to generate an air barrier pocket, which is void of coating liquid, at the side end of the zone adjacent to the edge dam, whereby coating liquid is maintained inwardly of the edge dam and leakage is prevented.

SUMMARY OF THE INVENTION

In accordance with the present invention, an improved edge dam assembly for an applicator for applying coating liquid to a moving web of paper carried through an application zone, wherein the application is of the type having a body defining a chamber therein with an elongate opening to the chamber positionable generally adjacent to and transversely across the web, the chamber receiving coating liquid and directing the same through the opening and into the application zone for being applied onto the web, comprises seal means mountable at a side end of the opening and zone and means for introducing a gas under pressure through the seal means and into the zone to generate at the side end of the zone and adjacent the seal means a pressurized gas barrier pocket which is substantially void of coating liquid, whereby coating liquid in the zone is maintained inwardly of the seal means and prevented from leaking therepast.

The invention also contemplates an improved method of applying coating liquid to a moving web of paper by applying coating liquid to one surface of the web as it is carried through an application zone having spaced front and rear edges and laterally spaced side ends, which comprises the steps of forming and maintaining a reservoir of coating liquid on the web in the zone by introducing coating liquid into a chamber having front and rear walls the upper ends of which define the front and rear edges of the zone and an opening to the zone, and flowing the coating liquid in the chamber through the opening and into the zone; doctoring the coating liquid on the web at the rear edge of the zone; and maintaining the coating liquid in the zone by substantially sealing the front, rear and side edges of the zone. In this connection, the improvement comprises the steps of sealing each side edge of the zone by substantially closing the outermost end of the side edge, and introducing into the side edge of the zone adjacent to and inwardly of its outermost end a flow of gas to generate at the side edge and adjacent the outermost end a pressurized gas barrier pocket which is substantially void of coating liquid, whereby coating liquid is prevented from moving past the side edge of the zone.

The foregoing and other objects, advantages and features of the invention will become apparent upon a consideration of the following detailed description, when taken in conjunction with the accompanying drawings.

BRIEF DESCRIPTION OF THE DRAWINGS

FIG. 1 is a longitudinal elevation view of an edge dam assembly constructed in accordance with the teachings of the present invention, illustrating the same on an applicator for applying a coating liquid to a moving web of paper carried on a backing roll;

FIG. 2 is a perspective view of the edge dam assembly, and

FIG. 3 is a cross sectional side elevation view of the edge dam assembly, taken substantially along the lines 3—3 of FIG. 1.

DETAILED DESCRIPTION

Referring to the drawings, there is indicated generally at 20 an applicator of a type with which an edge dam or edge seal assembly, indicated generally at 22 and configured in accordance with the teachings of the invention, is particularly adapted for use. The applicator is of the trailing blade type and applies a pigment bearing liquid coating to a moving web of paper 24 carried on a resilient backing roll 26 in a direction indicated by an arrow 28. The applicator includes a housing 30 having a coating liquid chamber defined between a front or leading wall 32 and a rear or trailing wall 34 of the housing. The walls extend generally transversely across the backing roll and taper toward an open upper end or elongate application zone 36 of the chamber. Coating liquid introduced into the chamber under pressure flows through a metering slot 38 between the front and rear walls, as shown by an arrow, into the application zone and against the web of paper. Although not shown, it is understood that opposite sides of the housing, and therefore of the metering slot, are closed by side walls extending between the front and rear walls.

During operation, the coating applicator 20 is positioned closely adjacent the backing roll 26 with the application zone 36 facing the surface of the paper web 24. A flexible doctor blade 40 at the trailing end of the zone is clamped against the housing rear wall 34 and urged against the web by any suitable means (not shown), such for example as by a pair of transversely extending air tubes as taught in U.S. Pat. No. 4,250,211. The doctor blade serves several functions, one of which is to level and meter the coating applied to the web and another of which is to form a seal at the trailing end of the zone to prevent escape therepast of excessive amounts of coating liquid. An orifice plate 42 is mounted and vertically adjustable on the upper end of the housing front wall 32, such that an upper free edge 44 of the plate extends toward but is closely spaced from the web to define therewith a narrow orifice 46 extending transversely of the web at the leading end of the zone, through which excess coating material escapes from the zone. A copious excess of coating material is supplied to the chamber and thence through the metering slot 38 into the application zone, such that material escaping through the orifice 46 forms a liquid seal in the orifice and provides, along with the edge dams 22, the orifice plate and the doctor blade, a substantially closed application zone through which the paper web passes for being coated by coating liquid under pressure.

To the extent described, the applicator is of the type disclosed in aforementioned U.S. Pat. No. 4,250,211, issued to Damrau et al. and assigned to the assignee of the present invention, the teachings of which are specifically incorporated herein by reference.

To seal the spaces at the side ends of the application zone 36 between the orifice plate 42, backing roll 26 and doctor blade 40, an edge dam assembly 22 is positioned at each side end of the zone. As will become apparent, in improving upon conventional edge dams the edge dam assembly of the invention seals coating liquid in the application zone partially by means of providing a pressurized air barrier within the zone immediately inwardly of the edge dam, which maintains coating liquid out of contact with the edge dam and substantially prevents escape of coating liquid from the zone.

With reference to the drawings, each edge dam assembly comprises a main body 48, which may be of nylon, metal or any other suitable material. At one end of the main body is carried a somewhat triangular shaped seal element 50 which is configured to generally fill the opening at an end of the application zone 36 between the orifice plate 44, doctor blade 40 and backing roll 26, with the element being in sealed engagement with the orifice plate and doctor blade but spaced from the backing roll. A passage is formed longitudinally through the main body, and is provided with an air inlet fitting 52 at one end and a somewhat elongate air outlet nozzle 54 at an opposite end at the seal element. The passage and air nozzle internal diameters may be on the order of about 3/16 inch, and the air inlet fitting connects with compressed air from a supply thereof (not shown) through an air line 56, whereby compressed air flows through the passage to the air outlet nozzle for exit from an outer end 58 of the nozzle. A slide plate 60 extending longitudinally along the main body is slidably connected with a lower surface of the body by means of a dovetail slot, and is longitudinally adjustable with respect to the main body by means of a rod 62 having a ring 64 at its outer end, thereby to extend an end of the plate a selected distance beyond the end of the main body. To secure the slide plate in position once adjusted, a set screw 66 carried in a flange 68 of the main body may be rotated into engagement with the rod.

The generally triangular shape of the seal element 50 enables the edge dam assembly 22 to be mounted in the space between the doctor blade 40, orifice plate 42 and backing roll 26 at a side end of the application zone 36. For the purpose, and as shown in FIG. 1, the downwardly depending flange 68 of the main body 48 has a passage 70 which receives a rod 72 extending outwardly of the applicator transversely of the application zone. The flange is secured to the rod by means of a set screw 74, which enables the edge dam assembly to be conveniently removed from the applicator by being slid transversely therefrom for cleaning, repair or replacement. With the edge dam assembly mounted between the doctor blade and orifice plate, the upper end of the triangular shaped seal element extends toward and adjacent to but spaced from the backing roll. At the same time, the sides of the seal element are positioned against and seal with the doctor blade and orifice plate.

FIGS. 1 and 3 illustrate the mounting arrangement of the edge dam assembly 22 on the applicator. As is apparent, the configuration and size of the seal element 50 is quite important, and the element must substantially fill the area between the doctor blade, orifice plate and backing roll. If the element is too small, coating liquid will seep therepast. If the element is too large, the doctor blade will be held from its doctoring position against the paper web and/or the element will engage the backing roll or web.

In operation, air at a pressure greater than the pressure of coating liquid in the application zone 36 is introduced through the air inlet fitting 52 and exits from the outlet end 58 of the nozzle 54 into the zone toward a side end thereof adjacent to the seal element 50. Normally, 1–10 psig air pressure is sufficient, although the pressure may vary depending upon the pressure of coating liquid in the zone. The air forces coating liquid away from the side end of the zone and forms a pressurized air barrier pocket in the zone at the side edge thereof adjacent to the seal element, which pocket is void of coating liquid. Consequently, coating liquid is maintained inwardly of the seal element for application on the paper web, but cannot escape laterally past the element and out of the application zone. As shown in the drawings since the seal element does not rely on a closely spaced relationship with the web or backing roll to form a seal, the upper edge of the element may be spaced somewhat further from the backing roll and paper web and would be the case with conventional edge dams, thereby to facilitate a flow of air out of the application zone so that the air does not move into the coating liquid therein and cause "skips" in the film of coating applied on the web. Together with the flow rate of gas into the zone, the seal means is configured, or spaced an amount from the web, to accommodate escape of gas from the gas barrier pocket to external of the applicator at a rate which maintains a substantially constant volume gas barrier pocket.

As described, coating liquid is introduced into the application zone 36 through the metering slot 38 which extends along and substantially coextensively with the zone, and upon exiting the slot flows upwardly into the zone. Absent the slide plate 60, coating liquid introduced into the side ends of the zone would tend to flow into the air barrier pocket generated inwardly of the seal element 50, thereby destroying the integrity of the pocket and causing coating liquid to be applied onto the edge of the web, which is desirably left uncoated, and possibly to leak past the seal element. However, the slide plate 60 is longitudinally adjustable along the main body 48 to extend a selected distance beyond the outlet end 58 of the air nozzle 54 and over the portion of the metering slot therebeneath, and blocks or deflects coating liquid which would otherwise be directed into the air pocket. At the same time, the degree of extension of the slide plate beyond the air nozzle, taken together with the pressure of air flowing through the nozzle and the longitudinal positioning of the edge dam assembly on the rod 72, controls the longitudinal extent of the air pocket into the application zone, and thereby the width of the uncoated strip on the side end of the web. Should some coating liquid nevertheless escape past the seal element 50, a surface 76 on the upper surface of the main body is tapered downwardly toward the forward end of the applicator and is wider at the air outlet end of the assembly than at the air inlet end to present a further barrier to coating liquid escaping the applicator, inasmuch as the liquid would be required to run uphill to escape.

As compared with conventional edge dam assemblies which must be positioned in very close proximity with the web to control seepage of coating liquid from the application zone, and yet nevertheless allow an unacceptable amount of coating liquid to escape, the edge dam assembly of the invention provides secure seals at the side ends of the zone to significantly minimize, if not eliminate, seepage of coating liquid therefrom. By means of adjusting the pressure of air introduced into the side end of the application zone through the air nozzle 54 and the amount of extension of the slide plate 60 beyond the nozzle, the edge dam assembly may be controlled so that substantially no coating liquid seeps therepast, despite the fact that the assembly may be spaced a reasonable distance from the web. Consequently, the edge dam assembly permits a dry or uncoated narrow strip to remain on each side edge of the paper web and eliminates coating liquid buildup on rolls following the applicator and edge stickers on the wound paper roll.

While one embodiment of the invention has been described in detail, various modifications and other embodiments thereof may be devised by one skilled in the art without departing from the spirit and scope of the invention, as defined in the appended claims.

What is claimed is:

1. An improved edge dam assembly for an applicator for applying coating liquid to a moving web of paper carried through an application zone, wherein the applicator is of the type having a body defining a chamber therein with an elongate opening to the chamber positionable generally adjacent to and transversely across the web, the chamber receiving coating liquid and directing the same through the opening and into the application zone for being applied onto the web, said edge dam assembly comprising seal means mountable at a side end of the opening and zone inwardly of the side edge of the web and having a passage therethrough in communication with the side end of the zone; means for introducing a gas under pressure through said seal means passage and into the zone to generate at the side end of the zone adjacent to said seal means a pressurized gas barrier pocket which extends inwardly of said seal means and web edge into the zone and is substantially void of coating liquid, whereby coating liquid in the zone is maintained inwardly of said seal means and prevented from leaking therepast; and a plate adjustable to move an end thereof into the side end of the zone a limited distance inwardly of said seal means and between said seal means and the chamber opening thereat to block coating liquid introduced into the zone through the chamber opening thereat from being directed toward said gas barrier pocket to control the inward extent of said gas barrier pocket into the side end of the zone and the extent of an uncoated margin on the web edge.

2. An improved edge dam assembly as in claim 1, wherein the coating liquid in the application zone is maintained under pressure and said introducing means introduces gas through said seal means passage into the side end of the zone at a controlled rate and at a pressure greater than the pressure or coating liquid in the zone, said seal means, in combination with the rate of introduction of gas into the zone, being configured to accommodate escape of gas from said gas barrier pocket to external of the applicator at a rate which maintains a substantially constant volume gas barrier pocket.

3. An improved edge dam assembly as in claim 2, wherein said seal means defines a gap with the web to accommodate escape of gas from the pocket.

4. An improved edge dam assembly as in claim 1, wherein said seal means comprises a seal element having said passage therethrough and mountable at the side end of the opening and application zone, and said means for introducing includes an elongate nozzle coupled with said passage through said seal element, said nozzle extending from said passage into the zone inwardly of said seal element, and means for flowing gas through said passage and nozzle into the side end of the zone to discharge gas from said nozzle into the zone inwardly of said seal element.

5. An improved edge dam assembly as in claim 4, wherein said seal element and nozzle are mounted at an end of an elongate, relatively rigid member, said member having a passage therethrough in communication with said seal element passage and nozzle and said introducing means introduces gas under pressure into said member passage, said member being mountable on the applicator to mount said edge dam assembly thereon.

6. An improved edge dam assembly as in claim 5, wherein said plate is adjustably mounted on said member for movement of said end thereof said limited distance into the side end of the application zone inwardly of said nozzle and between said nozzle and the chamber opening thereat to block coating liquid introduced into the zone through the chamber opening thereat from being directed toward said gas barrier pocket and to control the inward extent of said pocket into the side end of the zone.

7. An improved applicator and edge dam assembly for applying coating liquid to a moving web of paper carried through an application zone, comprising a body defining a chamber therein with an elongate opening to said chamber positionable generally adjacent to and transversely across the web, said chamber receiving coating liquid therein and directing the same through said opening and into said application zone for being applied onto the web; a front wall extending from a front side of said chamber opening toward, adjacent to and substantially transversely across the web; a doctor blade extending from a rear side of said chamber opening substantially transversely across and against the web for doctoring coating liquid on the web; and edge dam assemblies at opposite side ends of said front wall and doctor blade for sealing the end spaces therebetween and the side ends of said application zone inwardly of the edges of the web thereat, the improvement being characterized in that each said edge dam assembly comprises seal means mounted between and sealed with said front wall and doctor blade and extending toward but spaced from the paper web inwardly of the edge thereof, said seal means having a passage therethrough; means for introducing a gas under pressure through said seal means passage and into said zone to generate at the side end of said zone adjacent to said seal means a pressurized gas barrier pocket which extends inwardly of said seal means and web edge into said zone and is substantially void of coating liquid, whereby coating liquid in said zone is maintained inwardly of said seal means and prevented from leaking therepast; and a plate adjustable to move an end thereof into the side end of said zone a limited distance inwardly of said seal means and between said seal means and the side end of said chamber opening thereat to block coating liquid introduced into said zone through said chamber opening thereat from being directed toward said gas barrier pocket to control the inward extent of said gas barrier pocket into said side end of said zone and the extent of an uncoated margin on the web edge.

8. An improved applicator and edge dam assembly as in claim 7, wherein coating liquid in said application zone is maintained under pressure and said introducing means introduces gas through said seal means passage into the side end of said zone at a controlled rate and at a pressure greater than the pressure of coating liquid in said zone, said seal means, in combination with the rate of introduction of gas into said zone, being configured to accommodate escape of gas from said gas barrier pocket to external of said applicator at a rate which maintains a substantially constant volume gas barrier pocket.

9. An improved applicator and edge dam assembly as in claim 7, wherein said seal means comprises a seal element having said passage therethrough and mounted between and sealed with said front wall and doctor blade at the side end of said application zone, and said means for introducing includes an elongate nozzle coupled with said passage through said seal element, said nozzle extending from said passage into said zone inwardly of said seal element, and means for flowing gas through said passage and nozzle into the side end of said zone to discharge gas from said nozzle into said zone inwardly of said seal element.

10. An improved applicator and edge dam assembly as in claim 9, wherein said seal element and said nozzle are mounted at an end of an elongate, relatively rigid member, said member having a passage therethrough in communication with said seal element passage and nozzle and said introducing means introduces gas under pressure into said member passage, said member being mounted on said applicator to mount said edge dam assembly thereon.

11. An improved applicator and edge dam assembly as in claim 10, wherein said plate is adjustably mounted on said member for movement of said end thereof said limited distance into said side end of said application zone inwardly of said nozzle and between said nozzle and said chamber opening thereat to block coating liquid introduced into said zone through said chamber opening thereat from being directed toward said gas barrier pocket and to control the inward extent of said pocket into the side end of said zone.

12. An improved method of applying coating liquid to a moving web of paper by applying coating liquid to one surface of the web as it is carried through an application zone having spaced front and rear edges and laterally saced side ends, comprising the steps of forming and maintaining a reservoir of coating liquid on the web in the zone by introducing coating liquid into a chamber having front and rear walls the upper ends of which define the front and rear edges of the zone and an opening to the zone, and flowing the coating liquid in the chamber through the opening and into the zone; doctoring the coating liquid on the web at the rear end of the zone; and maintaining the coating liquid in the zone by substantially sealing the front, rear and side edges of the zone, the improvement comprising the steps of sealing each side edge of the zone by substantially closing the outermost end of the side edge; introducing into the side edge of the zone adjacent to and inwardly of its substantially closed outermost end a flow of gas to generate at the side edge adjacent to and extending inwardly of the substantially closed outermost end and the web edge a pressurized gas barrier pocket which is substantially void of coating liquid, whereby coating liquid is prevented from moving past the side edge of the zone; and blocking for a limited and adjustable distance into the side edge of the zone coating liquid flowing through the chamber opening and into the zone at the side edge thereof from being directed toward the gas barrier pocket to control the inward extent of the gas barrier pocket into the side edge of the zone and the extent of an uncoated margin on the web edge.

13. A method as in claim 12, wherein coating liquid in the zone is maintained under pressure and said introducing step comprises introducing gas into the side edge of the zone at a pressure greater than the pressure of coating liquid in the zone, and including the step of accommodating escape of gas from the gas barrier pocket to external of the zone at a rate to maintain a substantially constant volume gas barrier pocket at the side edge of the zone.

14. A method as in claim 12, wherein said blocking step comprises establishing a barrier in the application zone between the gas barrier pocket and the chamber opening thereat and extending the limited distance into the zone from the zone side edge.

15. An improved method of applying coating liquid to a moving web of paper by applying coating liquid to one surface of the web as it is carried through an application zone having spaced front and rear edges and laterally spaced side ends, comprising the steps of forming and maintaining a reservoir of coating liquid on the web in the zone by introducing coating liquid into a chamber having front and rear walls the upper ends of which define the front and rear edges of the zone and an opening to the zone, and flowing the coating liquid in the chamber through the opening and into the zone; doctoring the coating liquid on the web at the rear edge of the zone; and maintaining the coating liquid in the zone by substantially sealing the front, rear and side edges of the zone, the improvement comprising the steps of sealing each side edge of the zone by substantially closing the outermost end of the side edge, and introducing into the side edge of the zone adjacent to and inwardly of its substantially closed outermost end a flow of gas to generate at the side edge adjacent to and extending inwardly of the substantially closed outermost end and the web edge a pressurized gas barrier pocket which is substantially void of coating liquid, whereby coating liquid is prevented from moving past the side edge of the zone and an uncoated margin is maintained on the edge of the web.

* * * * *